US006615798B2

(12) United States Patent
Orton

(10) Patent No.: US 6,615,798 B2
(45) Date of Patent: Sep. 9, 2003

(54) INTERNAL COMBUSTION ENGINE HAVING MULTIPLE INTAKE VALVES, ONE VALVE ADAPTED FOR HIGHER SPEED

(76) Inventor: Kevin R. Orton, 257 Avenida Lobeiro, Unit G, San Clemente, CA (US) 92672

( * ) Notice: Subject to any disclaimer, the term of this patent is extended or adjusted under 35 U.S.C. 154(b) by 0 days.

(21) Appl. No.: 10/100,572

(22) Filed: Mar. 15, 2002

(65) Prior Publication Data

US 2002/0139349 A1 Oct. 3, 2002

Related U.S. Application Data

(60) Provisional application No. 60/281,260, filed on Apr. 3, 2001.

(51) Int. Cl.[7] ..... F02B 15/00

(52) U.S. Cl. ..... 123/432; 123/438; 123/90.15; 123/306

(58) Field of Search ..... 123/432, 438, 123/90.15, 90.22, 90.23, 90.4, 188.1, 302, 306, 308

(56) References Cited

U.S. PATENT DOCUMENTS 5,070,824 A * 12/1991 Morishita ..... 123/41.82 R
5,174,260 A * 12/1992 Nonogawa et al. ..... 123/432
5,230,317 A * 7/1993 Nonogawa et al. ..... 123/432
5,549,088 A * 8/1996 Isaka ..... 123/308
5,555,869 A * 9/1996 Uchida ..... 123/308
5,669,348 A * 9/1997 Nishigaki et al. ..... 123/308
5,720,259 A * 2/1998 Sakurai et al. ..... 123/432
6,148,794 A * 11/2000 Tsuzuku et al. ..... 123/406.5

* cited by examiner

*Primary Examiner*—Hieu T. Vo
*Assistant Examiner*—Johnny H. Hoang
(74) *Attorney, Agent, or Firm*—Calif Tervo

(57) ABSTRACT

An internal combustion engine 10 comprises a cylinder 12 including a combustion chamber 17 having at least two air input ports 31, 51 and a piston 18 movable in cylinder 12 so as to vary the volume of combustion chamber 17. An air supply system 20 for supplying combustion air to cylinder 12 comprises first and second air intake systems 30, 50, each including an air passage 33, 53 and a valve 40, 60 controlling air passage through their respective port 31, 51. Each valve is controlled such that second valve 60 is open longer than first valve 40. An air flow valve controller 72 responsive to engine speed and air pressure downstream of a throttle valve 24 moves a valve 81 in second passageway 53 to permit greater air flow through second air passage 53 at higher engine speed and at air pressure less than steady state air pressure for the engine speed.

19 Claims, 1 Drawing Sheet

INTERNAL COMBUSTION ENGINE HAVING MULTIPLE INTAKE VALVES, ONE VALVE ADAPTED FOR HIGHER SPEED

CROSS-REFERENCE TO RELATED APPLICATIONS

This application claims the benefit of U.S. Provisional Application No. 60/281,260, filed Apr. 3, 2001.

FIELD OF THE INVENTION

This invention relates to a dual intake valve engine with the timing of one valve being more appropriate for high engine speed and including a controller for controlling the air flow to that valve dependent upon engine speed and air pressure in the intake system.

BACKGROUND OF THE INVENTION

When tuning an engine for better performance, one variable the engine designer will work with is the intake valve open and close time, in relation to the crankshaft rotation. The valve timing is customarily measured in degrees of crankshaft rotation, either before top dead center (BTDC) or after top dead center (ATDC) or before or after bottom dead center (BBTC, ABDC).

Usually, on a four stroke automobile engine, a camshaft controls the intake valve operation. Lobes on the camshaft apply pressure to the top of the valve stem and cause the valve to open and close as the camshaft turns. The camshaft is driven in coordination with the crankshaft of the engine, usually through belts or gears, and is synchronized with the crankshaft so that the valve opens and closes at the desirable time of the Otto cycle.

It is known that the optimum camshaft profile and valve timing specification varies according to the speed of the engine. When the engine is operating at a low speed, i.e. low rpm, such as when idling, the optimum camshaft profile is close to the theoretically normal opening and closing points, for example 0 degree ATDC and 180 degrees ATDC on the intake cycle. This is in order to maintain a steady, smooth, and strong idle. Such camshaft and valve timing may be considered "slow speed" or "conservative." However, at higher engine speeds, usually above 2000 rpm, because of inertial effects of the intake air as it moves faster, the optimum intake valve opening time is earlier, for example 15° BTDC, and the optimum closing time is later, for example 220° ATDC. This "high speed" or "hot" camshaft profile improves air scavenging and provides more torque and power at high rpm, but will cause rough idling and increased emissions at low speed. The effect of having the optimum versus non-optimum valve timing at any given engine speed can easily amount to a 10–20% or more change in the power output of the engine. Thus the engine designer is left with contradictory optimizations. Higher specific power outputs allow the designer to reduce the engine size, thus reducing costs and increasing fuel efficiency.

Current systems seek to correct this dilemma with various mechanisms. One such mechanism consists of various cams, levers, and pulleys that alter the relationship between the crankshaft rotation and the camshaft rotation at various speeds. By altering the rotational timing relationship between the crankshaft and the camshaft, the effective valve timing may be altered. Another system uses rocker arm and lifter arrangements that cause the intake valves to open and close at different times at different engine rpms. Such rocker arms and mechanisms have various mechanical portions to effect the changes in valve opening and closing timing. Such systems often offer only fixed step changes to timing requirements, for example a setting for low speed operation, and a setting for high speed operation. Thus there is some compromise between the optimum valve timing at any engine speed, and the actual valve timing available. Typical prior art systems are complex and costly such that they are found only on expensive automobiles.

Thus there is a need for an improved system for effectively changing intake valve timing over various engine speeds. Particularly, a system that is economical, does not use complex mechanisms, and can provide more fully effective variable intake valve timing.

DETAILED DESCRIPTION OF THE INVENTION

Figures 1, 2, 3:
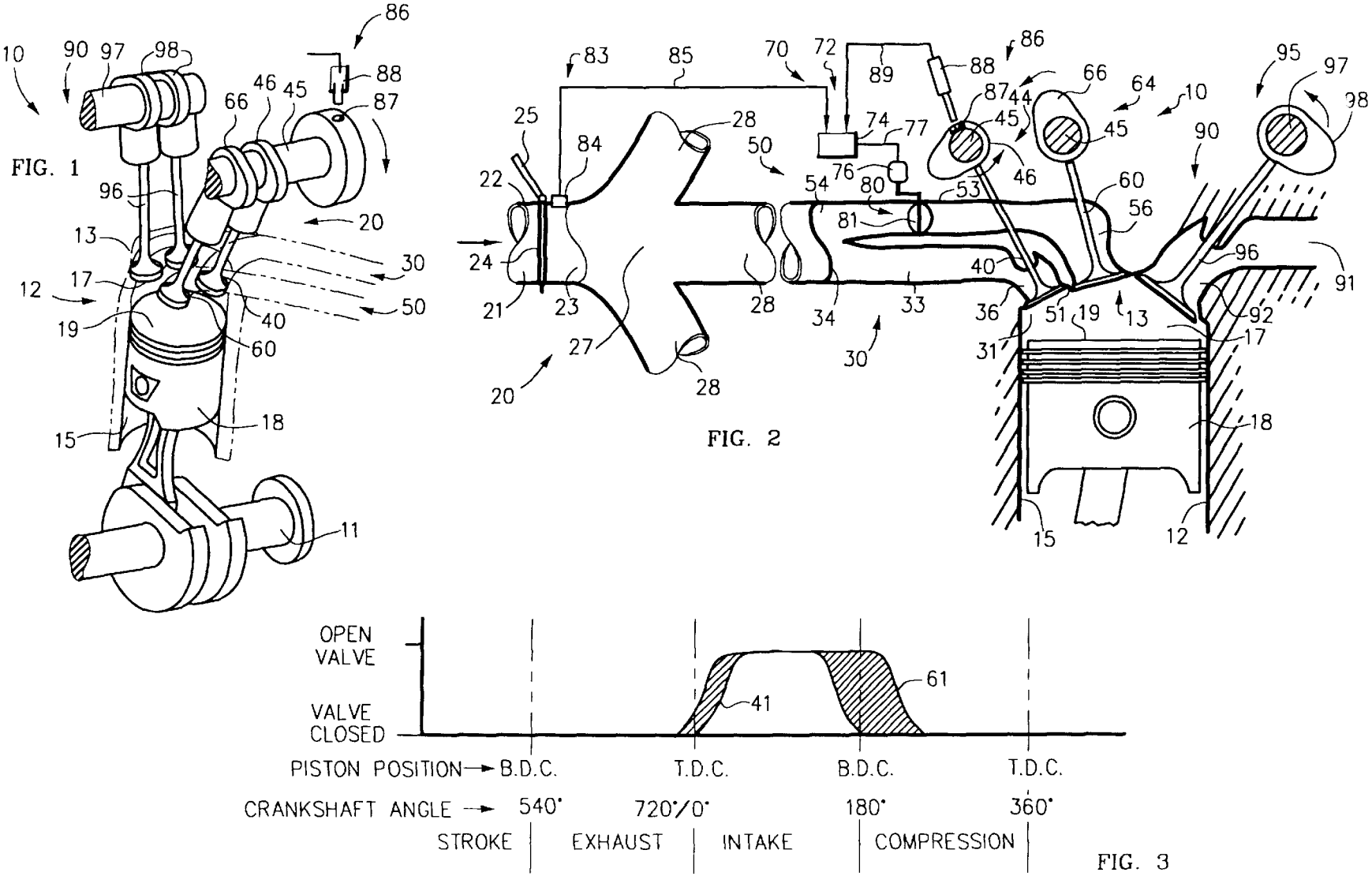
FIG. 1 is a partially cut away perspective view of a typical dual-overhead-cam, four-valve, piston, internal-combustion engine.
FIG. 2 is a diagram depicting a preferred embodiment of an internal combustion engine, shown partially in section, including the system of the invention.
FIG. 3 is a graph depicting a preferred embodiment of the positions of the slow-speed air intake valve and high-speed air intake valves relative to position of the piston.

With reference now to the drawing, there is shown in FIG. 1 a partially cut away perspective view of a common four-stroke, internal-combustion engine 10. Engine 10 generally includes a cylinder 12 having a head 13 and a side wall 15 and having a piston 18 therein. Part of the volume of cylinder 12 is a combustion chamber 17. Combustion chamber 17 is located between the top side 19 of piston 18 and cylinder head 13. Piston 18 reciprocates in cylinder 12 so as to vary the volume of combustion chamber 17. Piston 18 is connected to and turns crankshaft 11. Although only one cylinder 12 is shown, engine 10 would typically include more cylinders.

An air supply system 20 includes intake camshaft 45 including cams 46,66 that open and close intake valves 40,60 in cylinder head 13. An exhaust system 90 includes an exhaust camshaft 97 including cams that open and close exhaust valves 96 on cylinder head 13. Camshafts 45,97 are typically driven by belts or gears, not shown, connected to drive shaft 11 so as to be synchronized therewith but rotating at one half the speed thereof.

FIG. 2 is a diagram depicting a preferred embodiment of internal combustion engine 10, shown partially in section, including the system of the invention.

An exhaust system 90 removes exhaust gases from cylinder 12. Exhaust system 90 includes exhaust passage 91 including exhaust port 92 at one end for receiving combusted gasses from cylinder 12, and valve means 95 for opening and closing port 92. Exhaust passage 91 conducts combusted gasses away from combustion chamber 17 via exhaust port 92 and expels them, such as to the atmosphere. Valve means 95 includes exhaust valve 96 and means, such as exhaust cam 98 on exhaust camshaft 97, for operating valve 96.

Air supply system 20, supplying combustion air to cylinder 12, generally comprises a throttle passage 21 having a first end 22 positioned for receiving air, such as air from an air cleaner or atmospheric air, and a second end 23, a manifold 27 having a first end connected to throttle passage 21 and a plurality of arms 28 providing passages for distributing air to individual cylinders 12. A throttle valve 24 located in throttle passage 21 and controlled by linkage means 25, partially shown and well-known in the art, regulates air flow through throttle passage 21.

A first or "slow speed" air intake system 30, supplying air to cylinder 12, comprises a first air intake port 31 in cylinder head 13 and a first air passage 33 including a first end 34 positioned for receiving air, such as from throttle passage 21, and a second end 36 in communication with first intake port 31, a first valve 40, and first valve control means 44, including camshaft 45 and cam 46. First valve 40 opens and closes to control passage of air through first air intake port 31. Camshaft 45 and cam 46 open and close first valve 40 as is well-known in the art. Other valve control components, such as springs and guides for valve 40, are well-known in the art and are not shown.

A second or "high speed" air intake system 50, supplying air to cylinder 12, comprises a second air intake port 51 in cylinder head 13 and a second air passage 53 including a first end 54 positioned for receiving air, such as from throttle passage 21, and a second end 56 in communication with second air intake port 51, a second valve 60, and second valve control means 64, including camshaft 45 and cam 66. Typically, a single camshaft 45, as seen in FIG. 1, would control both low speed valve 40 and high speed valve 60, although two separate camshafts could be used. In FIG. 2, camshaft 45 is shown in two locations, instead of the cross-sections being superimposed, to better illustrate cams 46, 66 and valves 40, 60. Second valve 60 opens and closes to control passage of air through second air intake port 51. Camshaft 45 and cam 66 open and close second valve 60 as is well-known in the art. Other valve control components, such as springs and guides for valve 60, are well-known in the art and are not shown.

FIG. 3 is a graph depicting a preferred embodiment of the positions of slow-speed air intake valve 40 and high-speed air intake valve 60 relative to position of piston 18.

Slow speed valve 40 is operated with "conservative" valve timing as depicted by curve 41 of FIG. 3. Slow speed valve 40 is typically opened about TDC and closed about BDC. This timing is most suitable for low speed and idling operation. High speed valve 60 is operated with "hot" valve timing as depicted by curve 61 of FIG. 3. High speed valve 60 is typically opened about 10° before TDC and closes about 40° after BDC. This timing is best suited for high rpm operation. These curves may easily be accomplished by grinding different valve lift profiles into the cam 46, 66 for each valve. Thus, cam 66 has a broader peak than cam 46. This invention takes advantage of the fact that the "hot" valve timing will usually encompass the "conservative" valve timing. That is to say, the high speed or "hot" valve usually opens earlier and/or closes later than the "conservative" valve. Thus the conservative, slow speed valve opening period is encompassed by the high speed "hot" valve period. Also, the high speed valve could open at or about the same time and close later.

Returning to FIG. 2, an air flow regulator 70, regulating air flow through second air passage 53, generally comprises an air flow valve controller 72, an air flow valve means 80, an engine speed sensor 86, and a pressure sensor 83.

Air flow valve means 80 may be a slide valve or other type of mechanism to control the airflow such as a butterfly valve 81, which is movable so as to regulate air flow through second air passage 53 to second valve 60. Air flow valve controller 72, for controlling valve 81, comprises a convertor, such as a programmed microprocessor or computer 74 connected by line 77 to means, such as servo motor 76 connected to valve 81 for moving valve 81.

Engine speed sensor 86 includes means, such as magnetic implant 87 in camshaft 45 and magnetic sensor 88 for detecting passage of implant 87 and for sending a signal on line 89 to computer 74 indicative of engine speed. Any of many engine speed sensors well known in the art could be used, such as one timing spark plug firings.

Computer 74 receives engine speed signal on 89 and instructs servo 76 on line 77 to move air flow valve 81 so as to permit relative greater air flow through second air passage 53 at higher engine speed and relative less air flow though second air passage 53 at lower engine speed.

Preferably, high speed air valve 81 is located physically close to the high speed intake valve 60. This minimizes the air volume downstream of valve 81, which reduces pumping losses that would otherwise occur when valve 81 is closed. Valve 81 regulates airflow to high speed intake valve 60, but does not affect the airflow to low speed valve 40. High speed valve 60 need not have fast response action, it need only open and close over a period of about 1 second. Preferably, valve 81 operates, as shown, independently of the main throttle valve 24. Valve 81 operates by closing off airflow to high speed valve 60 at low engine speeds. High speed valve 60 still opens and closes at low engine speeds, but no airflow enters second intake port 51 because airflow has been stopped by valve 81. Thus, even though high speed valve 60 is opening and closing at very low engine speeds, there are not the detrimental engine effects, such as scavenging losses and blow-by, that would occur if air were entering through second air passage 53.

As engine 10 speeds up, the intake air begins to exhibit more and more inertia effects. As this happens, valve 81 begins to open, thus permitting increasing amount of airflow though the high speed intake valve 60. The ratio of air permitted to flow through low speed intake valve 40 to the air permitted to flow through high speed intake valve 60 tracks the air inertia effects that occur as the engine speeds up, thus providing adapted combined intake timing at any engine speed.

The primary value used to determine the position of valve 81 is engine speed. However, in some circumstances, it is desirable to modify this setting depending on the load demand of engine 10. The load demand of engine 10 is determined by pressure sensor 83 in the intake air path. Pressure sensor 83 includes means, such as pressure detector 84 in throttle passage 21 downstream of throttle valve 24 measuring the pressure in throttle passage and sending a signal on line 85 to computer 74 indicating the sensed pressure. Pressure detector 84 can be located almost anywhere in air supply system downstream of throttle valve 24 except downstream of air flow valve 81.

Computer 74 is programmed to recognize and store a steady state air pressure value corresponding to a given engine speed and to move air flow valve 81 so as to permit greater air flow through second air passage 53 at air pressure that is less than the stored steady state air pressure value for the engine speed and lesser air flow though said second air passage 53 at air pressure higher than the stored steady state air pressure value for the engine speed. The specific algorithm for performing this task depends upon the given engine configuration, but may be originally estimated and then improved through testing.

When engine 10 is idling, running slowly, or has low load demands (such as when compression braking) computer 74 senses the low demand operation, as indicated by higher pressure detected by pressure indicator 84, and commands servo 76 to move valve 81 to restrict or stop airflow to high speed valve 81. As rpm increases, valve 81 opens more and more. As valve 81 opens, an increasing percentage of the total air intake of engine 10 flows through high speed valve 60. Low speed valve 40 continues to function/and supply supplementary air when valve 81 and high speed valve 60 are open. The combined airflows through low speed valve 40 and high speed valve 60 determine the overall effective valve intake timing. Thus, the effective air intake timing is modified by valve 81.

Air temperature and other sensor inputs to computer 74 may be used to fine tune operation. Once established, the algorithm that computer 74 uses to control valve 81 is generally fixed and does not require adjustment.

Although direct overhead camshaft 45 is shown, similar results may be obtained by using different rocker arm leverage ratios, lifter designs, gap settings, or the like, such that the two valves operate at different valve timings, without departing from the scope or intent of the invention. Also, each of the two (or more) intake valves per cylinder may be operated by the same camshaft, or they may be operated by separate camshafts. Generally, there is 3° or greater difference between the open and close times of valves 40, 60.

Intake passages 33, 53 may optionally be of a different length or size, so as to optimize each passage for optimum air flow effects in known ways.

A further advantage of engine 10 described herein is that is possible to employ a wide dynamic range (a high ratio of low speed intake valve opening to high speed intake valve opening) of operating conditions on one engine 10, something existing variable valve intake timing systems do not do well.

A further advantage of the system described herein, is that with intake valves 40, 60 opening and closing at different times, there is increased air turbulence within combustion chamber 17, helping to mix and atomize intake gasoline for improved combustion.

Having described the preferred embodiments of the present invention, many alterations and modifications which are within the inventive concepts disclosed herein will likely occur to those skilled in the art. For example, the illustrated embodiment uses one air valve 81 per cylinder 12. In a multi-cylinder engine, multiple valves may be linked together so as to open and close in unison. Alternately, in a multi-cylinder engine, a single air valve 81 controlling a manifold could be used for all cylinders simultaneously. In either case, one air flow regulator 70 can control all valves 81 together. Servo 76 may operate hydraulically, pneumatically, mechanically, or electrically, or use other known means. Other intake valve types may of course be used, such as rotary valves, as long as there are at least two of them and with separate intake air paths. Furthermore, the system may be adapted for use with the exhaust cycle of the engine, particularly when using a timing shift valve rated for high temperatures.

Thus, the invention provides a robust, effective, economical and practical method of extracting increased power and efficiency from the motor.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. An internal combustion engine comprising:

a cylinder including:
  a combustion chamber;

a piston movable in said cylinder so as to vary the volume of said combustion chamber;

an exhaust system for removing combustion gases from said cylinder including:
  an exhaust port in said cylinder; and an air supply system for supplying combustion air to said cylinder comprising:
  a first air intake system for supplying air to said cylinder comprising:
    a first air intake port in said cylinder;
    a first air passage including:
      a first end positioned for receiving air; and
      a second end in communication with said first intake port;
    a first valve controlling passage of air through said first air intake port; and
    first valve control means for opening and closing said first valve;
  a second air intake system for supplying air to said cylinder comprising:
    a second air intake port in said cylinder;
    a second air passage including:
      a first end for receiving air; and
      a second end in communication with said second air intake port;
    a second valve controlling passage of air through said second air intake port;
    second valve control means for opening and closing said second valve such that said second valve is open longer than said first valve; and
    an air flow regulator for regulating air flow through said second air passage comprising:
      air flow valve means for regulating air flow through said second air passage to said second valve; and
      an air flow valve controller connected to said air flow valve means and, responsive to engine speed, moving said air flow valve means so as to regulate air flow through said second air passage so as to permit greater air flow through said second air passage at higher engine speed and lesser air flow though said second air passage at lower engine speed.

2. The engine of claim 1 wherein:

said piston reciprocates in said cylinder.

3. The engine of claim 2 wherein:

said piston reciprocates twice per power stroke.

4. The engine of claim 1 wherein:

second valve control means opens said second valve before the opening of said first valve and closes said second valve after the closing of said first valve.

5. The engine of claim 1 wherein:

said air flow valve controller includes:
  an engine speed sensor for producing a speed signal indicative of engine speed.

6. The engine of claim 5 wherein:

said air flow valve controller includes:
  a computer connected to said engine speed sensor for receiving the speed signal therefrom.

7. An internal combustion engine comprising:

a cylinder including:
  a combustion chamber;

a piston movable in said cylinder so as to vary the volume of said combustion chamber;

an exhaust system for removing combustion gases from said cylinder including:
  an exhaust port in said cylinder; and an air supply system for supplying combustion air to said cylinder comprising:

a first air intake system for supplying air to said cylinder comprising:
a first air intake port in said cylinder;
a first air passage including:
a first end positioned for receiving air; and
a second end in communication with said first intake port;
a first valve controlling passage of air through said first air intake port; and
first valve control means for opening and closing said first valve;
a second air intake system for supplying air to said cylinder comprising:
a second air intake port in said cylinder;
a second air passage including:
a first end for receiving air; and
a second end in communication with said second air intake port;
a second valve controlling passage of air through said second air intake port;
second valve control means for opening and closing said second valve such that said second valve is open longer than said first valve; and
an air flow regulator for regulating air flow through said second air passage comprising:
air flow valve means for regulating air flow through said second air passage to said second valve; and
an air flow valve controller connected to said air flow valve means and, responsive to air pressure in a said air passage and not downstream of said air flow valve, moving said air flow valve means so as to permit greater air flow through said second air passage at lower pressure and lesser air flow though said second air passage at higher pressure.

8. The engine of claim 7 wherein:
said piston reciprocates in said cylinder.

9. The engine of claim 8 wherein:
said piston reciprocates twice per power stroke.

10. The engine of claim 7 wherein:
second valve control means opens said second valve before the opening of said first valve and closes said second valve after the closing of said first valve.

11. The engine of claim 7 wherein:
said air flow valve controller includes:
a pressure sensor in said air supply system.

12. The engine of claim 7 wherein:
said air flow valve controller includes:
a pressure sensor in said air supply system for producing a pressure signal indicative of the air pressure in said air supply system;
a computer connected to said pressure sensor for receiving the pressure signal therefrom.

13. The engine of claim 12 wherein:
said computer is programmed to recognize and store a steady state air pressure value corresponding to a given engine speed.

14. An internal combustion engine comprising:
a cylinder including:
a combustion chamber;
a piston movable in said cylinder so as to vary the volume of said combustion chamber;
an exhaust system for removing combustion gases from said cylinder including:
an exhaust port in said cylinder; and
an air supply system for supplying combustion air to said cylinder comprising:
a first air intake system for supplying air to said cylinder comprising:
a first air intake port in said cylinder;
a first air passage including:
a first end positioned for receiving air; and
a second end in communication with said first intake port;
a first valve controlling passage of air through said first air intake port; and
first valve control means for opening and closing said first valve;
a second air intake system for supplying air to said cylinder comprising:
a second air intake port in said cylinder;
a second air passage including:
a first end for receiving air; and
a second end in communication with said second air intake port;
a second valve controlling passage of air through said second air intake port;
second valve control means for opening and closing said second valve such that said second valve is open longer than said first valve; and
an air flow regulator for regulating air flow through said second air passage comprising:
air flow valve means for regulating air flow through said second air passage to said second valve; and
an air flow valve controller connected to said air flow valve means and, responsive to air pressure in a said air passage not downstream of said air flow valve and to engine speed, moving said air flow valve so as to permit greater air flow through said second air passage at higher engine speed and lesser air flow though said second air passage at lower engine speed and moving said air flow valve means so as to permit relative greater air flow through said second air passage at air pressure less than steady state air pressure for the engine speed and relative less air flow though said second air passage at air pressure higher than steady state air pressure for the engine speed.

15. The engine of claim 14 wherein:
said piston reciprocates in said cylinder.

16. The engine of claim 15 wherein:
said piston reciprocates twice per power stroke.

17. The engine of claim 14 wherein:
second valve control means opens said second valve before the opening of said first valve and closes said second valve after the closing of said first valve.

18. The engine of claim 14 wherein:
said air flow valve controller includes:
a pressure sensor in said air supply system for producing a pressure signal indicative of the air pressure in said air supply system;
engine speed sensor for producing a speed signal indicative of engine speed; and
a computer connected to said pressure for receiving the pressure signal therefrom and connected to said engine speed sensor for receiving the speed signal therefrom.

19. The engine of claim 18 wherein:
said computer is programmed to recognize and store the steady state air pressure.

* * * * *